US010806674B2

(12) United States Patent
Ogimoto et al.

(10) Patent No.: US 10,806,674 B2
(45) Date of Patent: Oct. 20, 2020

(54) TABLET PRINTING APPARATUS AND TABLET PRINTING METHOD

(71) Applicant: SHIBAURA MECHATRONICS CORPORATION, Yokohama-shi (JP)

(72) Inventors: Shinichi Ogimoto, Yokohama (JP); Ryo Ikuta, Yokohama (JP); Yutaka Okabe, Yokohama (JP); Hitoshi Aoyagi, Yokohama (JP); Hikaru Hoshino, Yokohama (JP)

(73) Assignee: SHIBAURA MECHATRONICS CORPORATION, Yokohama-shi (JP)

( * ) Notice: Subject to any disclaimer, the term of this patent is extended or adjusted under 35 U.S.C. 154(b) by 0 days.

(21) Appl. No.: 16/285,259

(22) Filed: Feb. 26, 2019

(65) Prior Publication Data

US 2019/0183733 A1 Jun. 20, 2019

Related U.S. Application Data

(63) Continuation of application No. PCT/JP2017/031314, filed on Aug. 31, 2017.

(30) Foreign Application Priority Data

Sep. 1, 2016 (JP) ..... 2016-170620

(51) Int. Cl.
*B41J 11/00* (2006.01)
*A61J 3/10* (2006.01)
(Continued)

(52) U.S. Cl.
CPC . *A61J 3/10* (2013.01); *A61J 3/06* (2013.01); *B41J 2/01* (2013.01); *B41J 3/4073* (2013.01);
(Continued)

(58) Field of Classification Search
CPC ..... A61J 3/10; A61J 3/06; B41J 3/60; B41J 2/01; B41J 3/4073; B41J 11/0095; B41J 11/0085; B41J 11/007; B41M 5/0088
See application file for complete search history.

(56) References Cited

U.S. PATENT DOCUMENTS 5,423,252 A 6/1995 Yamamoto et al.
2012/0056925 A1 3/2012 Yamagishi et al.
(Continued)

FOREIGN PATENT DOCUMENTS

JP 6-143539 5/1994
JP 2007-31007 2/2007
(Continued)

OTHER PUBLICATIONS

International Search Report dated Nov. 14, 2017 in PCT/JP2017/031314 filed Aug. 31, 2017.

*Primary Examiner* — Yaovi M Ameh
(74) *Attorney, Agent, or Firm* — Oblon, McClelland, Maier & Neustadt, L.L.P.

(57) ABSTRACT

According to one embodiment, a tablet printing apparatus includes a conveyor configured to convey tablets sequentially supplied while sucking and holding the tablets; a print head arranged to face the conveyor to perform printing on each of the tablets being conveyed; a detector arranged upstream of the print head to detect the posture of each of the tablets; and a print condition tester arranged downstream of the print head to check print condition on each of the tablets. Suction force applied to the tablets is reduced at least in an area from a detection position to a print condition check position than in other area.

7 Claims, 8 Drawing Sheets

(51) Int. Cl.

| | |
|---|---|
| ***A61J 3/06*** | (2006.01) |
| ***B41J 2/01*** | (2006.01) |
| ***B41J 3/60*** | (2006.01) |
| ***B41J 3/407*** | (2006.01) |
| ***B41M 5/00*** | (2006.01) |

(52) U.S. Cl.
CPC ..... *B41J 3/60* (2013.01); *B41J 11/007* (2013.01); *B41J 11/0085* (2013.01); *B41J 11/0095* (2013.01); *B41M 5/0088* (2013.01)

(56) References Cited

U.S. PATENT DOCUMENTS

| | | | | |
|---|---|---|---|---|
| 2013/0215204 | A1* | 8/2013 | Inoue | B41F 21/10 347/104 |
| 2014/0168309 | A1* | 6/2014 | Morita | B41J 3/407 347/16 |

FOREIGN PATENT DOCUMENTS

| | | | | |
|---|---|---|---|---|
| JP | 2012-51331 | | 3/2012 | |
| JP | 2013-13711 | | 1/2013 | |
| JP | 2015-204851 | A | 11/2015 | |
| JP | 2015204851 | A * | 11/2015 | A61J 3/00 |
| JP | 2016-141515 | | 8/2016 | |

* cited by examiner

TABLET PRINTING APPARATUS AND TABLET PRINTING METHOD

CROSS-REFERENCE TO THE RELATED APPLICATION

This application is based upon and claims the benefit of priority from International Application No. PCT/JP2017/031314, filed on Aug. 31, 2017 and Japanese Patent Application No. 2016-170620, filed on Sep. 1, 2016; the entire contents of all of which are incorporated herein by reference.

FIELD

Embodiments described herein relate generally to a tablet printing apparatus and a tablet printing method.

BACKGROUND

A tablet printing apparatus may be cited as an example of the apparatus that is used to print a letter, a character, a mark, or the like on the surface of a solid preparation such as a tablet (hereinafter simply referred to as "tablet"). The tablet printing apparatus performs transfer printing on a tablet using a roller that is provided with a pattern to be transferred on its surface. In the printing process, the tablet is held in a pocket by air suction to prevent it from shifting or the like, and thereby ink is transferred satisfactorily.

Besides those that use a roller to perform printing, an apparatus having an inkjet print head (hereinafter simply referred to as "print head") is also known because of, for example, ease of changing a print pattern and the like. When printing is performed on a tablet with the print head, if the tablet is being sucked and held by air suction as described above, an airflow is generated around the tablet by the suction of air around the tablet depending on the shape of the tablet, how the air is sucked, and the like.

When the airflow reaches the nozzle that ejects ink, the ink in or around the nozzle tends to dry quickly, which may result in, for example, disabling the nozzle to eject the ink when needed, or deviating the direction of ejection. This causes a reduction in print quality.

DETAILED DESCRIPTION

Figure 1:
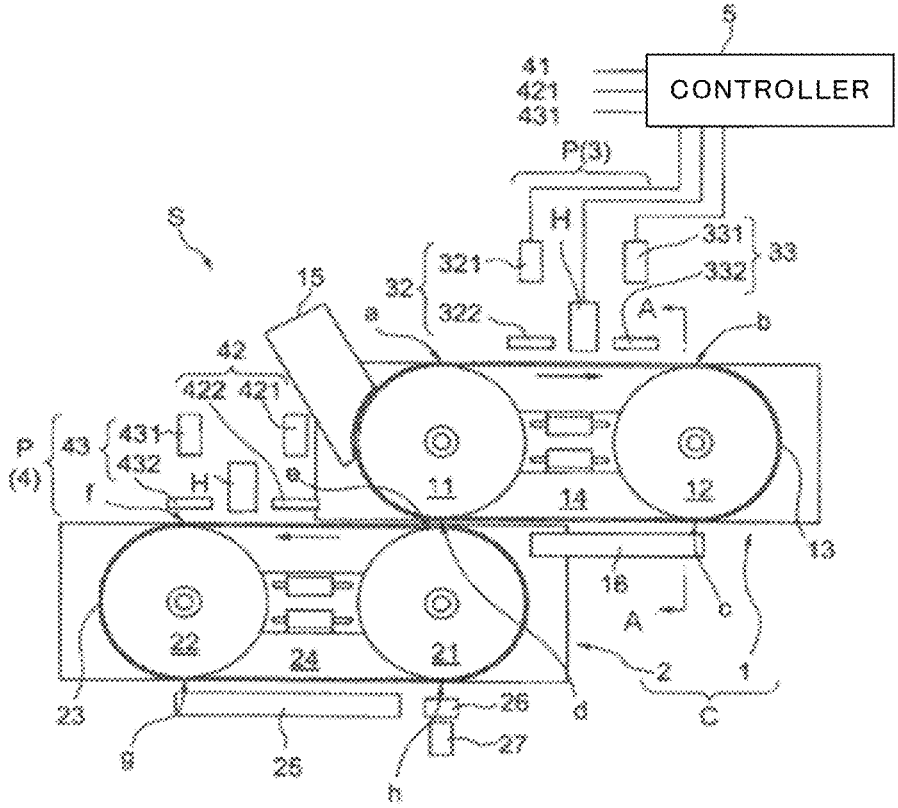
FIG. 1 is a front view of a tablet printing apparatus according to a first embodiment for illustrating the overall configuration thereof.

According to one embodiment, a tablet printing apparatus includes: a conveyor configured to convey tablets sequentially supplied while sucking and holding the tablets; a print head arranged to face the conveyor, and configured to eject ink to each of the tablets conveyed by the conveyor to perform printing; a detector located upstream of the print head in the conveying direction of the tablets, and configured to detect the posture of each of the tablets sucked and held by the conveyor; and a print condition tester located downstream of the print head in the conveying direction of the tablets, and configured to check print condition on each of the tablets sucked and held by the conveyor. The conveyor includes a first area and a second area. The first area includes at least an area from a detection position where the detector detects the tablets to a check position where the print condition tester checks the print condition on the tablets. The second area includes other area than the first area except for an area where no suction force is applied to the tablets. Suction force applied to the tablets is smaller in the first area than in the second area.

According to another embodiment, a tablet printing apparatus includes: a conveyor configured to convey tablets sequentially supplied while sucking and holding the tablets; a print head arranged to face the conveyor, and configured to eject ink to each of the tablets conveyed by the conveyor to perform printing; a detector located upstream of the print head in the conveying direction of the tablets, and configured to detect the posture of each of the tablets sucked and held by the conveyor; a print condition tester located downstream of the print head in the conveying direction of the tablets, and configured to check print condition on each of the tablets sucked and held by the conveyor; and a tablet supplier configured to supply the tablets to the conveyor. The conveyor includes a first area and a second area. In an area between a supply position where the tablet supplier supplies the tablets to the conveyor and a check position where the print condition tester checks the print condition on the tablets, the first area includes at least an area from a detection position where the detector detects the tablets to the check position. The second area includes other area than the first area in the area between the supply position and the check position. Suction force applied to the tablets is smaller in the first area than in the second area.

According to still another embodiment, a tablet printing method includes: conveying tablets sequentially supplied while sucking and holding the tablets; detecting the posture of each of the tablets being conveyed; ejecting ink to each of the tablets conveyed as being sucked and held to perform printing based on detection information; and checking print condition on each of the tablets being conveyed. Suction force applied to the tablets is reduced at least in an area including a detection position where the tablets are detected and a check position where the print condition on the tablets is checked than in other area.

Exemplary embodiments will be described with reference to drawings.

First Embodiment

FIG. 1 is a front view of a tablet printing apparatus S according to a first embodiment for illustrating the overall configuration thereof. The tablet printing apparatus S includes a conveying device (conveyor) C configured to convey tablets to be printed, and a printing unit (printer) P configured to perform printing on the tablets being conveyed by the conveying device C.

As illustrated in FIG. 1, in the tablet printing apparatus S, the conveying device C includes a first conveyor 1 and a second conveyor 2, which are arranged one above the other, to perform printing on both sides of a tablet. The printing unit P includes a first printer 3 and a second printer 4. The first printer 3 is arranged to face the first conveyor 1, while the second printer 4 is arranged to face the second conveyor 2. In other words, the first printer 3 is located above the first conveyor 1, while the second printer 4 is located above the second conveyor 2, and they, as a whole, constitute the tablet printing apparatus S.

In the first embodiment, the second conveyor 2 has basically the same structure as the first conveyor 1, and the second printer 4 has basically the same structure as the first printer 3. Therefore, in the following, the first conveyor 1 and the first printer 3 will be taken as examples to describe the conveying device C and the printing unit P.

The first conveyor 1 includes a first pulley 11, a second pulley 12, an endless conveyor belt 13, and a suction chamber 14.

The first pulley 11 is the left one of the two pulleys illustrated as circles in the first conveyor 1 in FIG. 1. The first pulley 11 is a driven pulley that rotates in response to the rotation of the second pulley 12 via the conveyor belt 13 without being connected to a drive source.

The second pulley 12 is the right one of the two pulleys in FIG. 1. In the first embodiment, the second pulley 12 is connected to a drive source, and serves as a drive pulley.

The conveyor belt 13 is an endless belt, and wrapped around the first pulley 11 and the second pulley 12. The conveyor belt 13 rotates as the first pulley 11 and the second pulley 12 rotate.

In the first embodiment, both the first pulley 11 and the second pulley 12 rotate clockwise. Accordingly, in the first conveyor 1, the conveyor belt 13 moves in the direction of the solid arrow, i.e., to the right from the first pulley 11 toward the second pulley 12 in the upper horizontal area.

Figure 2:
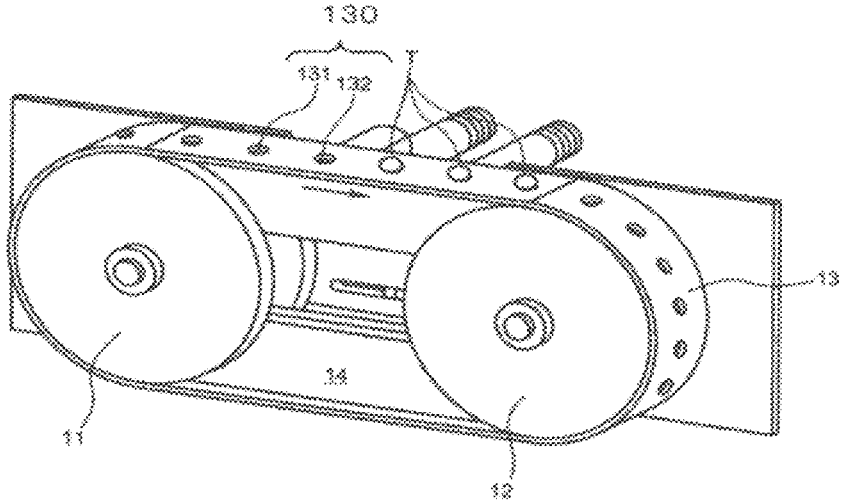
FIG. 2 is a perspective view of a conveying device illustrated in FIG. 1 for illustrating the overall configuration thereof.
Figure 3:
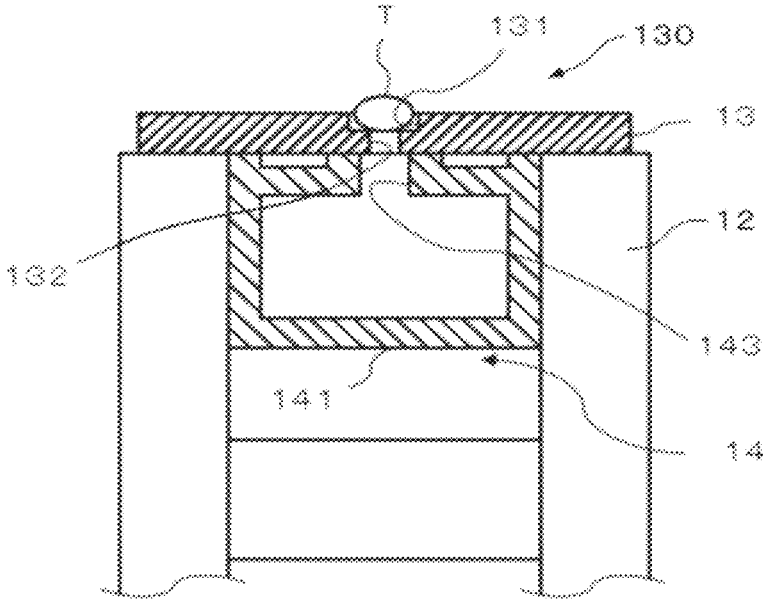
FIG. 3 is a partially cutaway cross-sectional view of the tablet printing apparatus taken along the line A-A in FIG. 1.

The structure of the conveyor belt 13 will be described more specifically with reference to FIGS. 2 and 3. FIG. 2 is a perspective view of the first conveyor 1 of the first embodiment for illustrating the overall configuration thereof. FIG. 3 is a cross-sectional view of the tablet printing apparatus S of the first embodiment taken along the line A-A in FIG. 1.

Note that the left side in FIG. 3 corresponds to the front side of the first conveyor 1 illustrated in FIG. 1. Besides, the second pulley 12 is not cross-sectionally cut in FIG. 3. In FIG. 3, the upper side of the second pulley 12 (above the rotation axis) corresponds to the position where the conveyor belt 13 comes in contact with the second pulley 12 after passing under the first printer 3 that performs printing on the tablets T and a print condition checking device (tester) 33, i.e., the position indicated by reference letter b (position b) in FIG. 1.

As illustrated in FIG. 2, the conveyor belt 13 is provided with a plurality of suction portions (suckers) 130 configured to suck and hold the tablets T to be printed on its surface. The suction portions 130 are formed at equal intervals over the entire circumference of the endless conveyor belt 13. FIG. 2 partially illustrates how the tablets T are sucked and held by the suction portions 130.

As illustrated in FIG. 3, the suction portions 130 each include a recess 131 such as a pocket for housing the tablet T and a suction hole 132 connected to the bottom of the recess 131. The suction hole 132 is formed in the bottom of the recess 131 of the conveyor belt 13 so as to extend therefrom toward the rear side of the conveyor belt 13. That is, through holes are formed in the conveyor belt 13. The suction of air by the suction chamber 14 (described later) acts on the tablets T each housed in the recess 131 through the suction hole 132. Thereby, the tablets T are sucked and held onto the conveyor belt 13.

As illustrated in FIG. 2, the suction chamber 14 is arranged inside the conveyor belt 13 over the entire circumference of the conveyor belt 13, and is configured to be able to apply a suction force to the suction portions 130 of the conveyor belt 13 (details will be described later).

Referring back to FIG. 1, the first printer 3 is located in a position facing the surface of the conveyor belt 13 that moves from the first pulley 11 toward the second pulley 12. In other words, the first printer 3 is arranged to face an area where the conveyor belt 13 travels from the first pulley 11 to the second pulley 12 (the upper horizontal area of the conveyor belt 13 between the positions a and b in FIG. 1).

The first printer 3 includes an inkjet print head H that performs printing on the tablets T, a position detecting device (detector) 32 that detects the position of each of the tablets T, and the print condition checking device (tester) 33 that checks print condition on the tablets T.

The position detecting device 32 is located upstream of the print head H in the traveling direction of the conveyor belt 13 (the conveying direction of the tablets T). The position detecting device 32 is configured to detect the position, orientation, and front/back of each of the tablets T to determine whether the tablet T is properly housed in the recess 131 formed in the surface of the conveyor belt 13. The position detecting device 32 includes an imaging device (imager) 321 that photographs each of the tablets T and an illumination 322 that illuminates the tablet T to be photographed. Having captured an image by photographing the tablet T, the imaging device 321 sends the image to a controller 5.

That is, the controller 5 implements part of the functions of the first printer 3 (the position detecting device 32) as an example. The controller 5 detects information such as the position, orientation, and front/back of the tablet T (hereinafter, these pieces of information are collectively referred to as "information on posture" or "posture information") by calculation based on the image received from the imaging device 321. Then, the controller 5 drives the print head H so as to perform appropriate printing (if the position of the tablet T has shifted, the controller 5 performs processing so as to correct the position shift or adjust the orientation, and performs printing) based on the detection result. Besides, for example, when the position shift falls out of the acceptable range, the controller 5 determines not to perform printing on the tablet T.

The print condition checking device 33 is located downstream of the print head H in the traveling direction of the conveyor belt 13. The print condition checking device 33 is configured to check the condition of a print that the print head H has generated on the upper surface of each of the tablets T. The print condition checking device 33 includes an imaging device (imager) 331 that photographs the print condition on each of the tablets T and an illumination 332 that illuminates the tablet T to be photographed. Having captured an image by photographing the tablet T, the imaging device 331 sends the image to the controller 5.

In this case also, the controller 5 implements part of the functions of the first printer 3 (the print condition checking device 33) as an example. The controller 5 detects print condition (print missing, print misalignment, etc.) on the tablet T based on the posture information thereof acquired by the position detecting device 32 and the image captured by the print condition checking device 33 to determine whether the print condition is defective or acceptable. When the print is determined to be defective, the tablet T is sent to a defective product collection box as will be described later.

A tablet supply device (supplier) 15 is arranged on the left side of the first pulley 11 of the first conveyor 1. The tablet supply device 15 stores a number of tablets T, and is configured to be able to supply the tablets T one by one to each of the recesses 131 of the conveyor belt 13.

A drying device (dryer) 16 is arranged below the first conveyor 1 to dry ink applied to the tablets T after printing. The drying device 16 is arranged to face an area where the conveyor belt 13 travels from the second pulley 12 to the first pulley 11 (the lower horizontal area of the first conveyor 1 between positions c and d in FIG. 1). That is, the drying device 16 is located in a position facing the conveyor belt 13. The drying device 16 is configured to dry ink applied to the tablets T by, for example, blowing hot air to the tablets T.

Note that the drying device 16 may be located in any position as long as it can dry ink applied to the tablets T without interfering with other mechanisms of the tablet printing apparatus S. In this embodiment, the drying device 16 is arranged between the position c where the conveyor belt 13, which rotates (moves in the reverse direction) with the rotation of the second pulley 12, separates from the second pulley 12 and a position on the first pulley 11 side where it does not interfere with the movement of a first pulley 21 in the second conveyor 2.

As illustrated in FIG. 1, the first conveyor 1 is arranged in the upper part of the tablet printing apparatus S, and the second conveyor 2 is arranged in the lower part thereof. After the first printer 3 performs printing on one surface (front surface) of the tablet T, the second conveyor 2 conveys the tablet T to the second printer 4 that performs printing on the other surface (back surface).

The second conveyor 2 is of basically the same structure as the first conveyor 1 as described above. That is, the second conveyor 2 includes the first pulley 21 as a driven pulley, a second pulley 22 connected to a drive source, an endless conveyor belt 23, and a suction chamber 24.

The first pulley 21 and the second pulley 22 rotate counterclockwise. Accordingly, the conveyor belt 23 that is wrapped around the pulleys 21 and 22 also rotates counterclockwise. That is, in FIG. 1, the conveyor belt 23 moves in the direction of the arrow illustrated in the upper horizontal area of the second conveyor 2, i.e., to the left.

The conveyor belt 23 conveys the tablets T with the rotation of the first pulley 21 and the second pulley 22. Similarly to the conveyor belt 13, the conveyor belt 23 is provided with suction portions on its surface to suck the tablets T each housed in a recess to thereby hold them on the surface (see the suction portions 130 in FIGS. 2 and 3).

The conveyor belt 23 faces the conveyor belt 13 of the first conveyor 1 on the downstream side of the drying device 16 of the first conveyor 1. Therefore, in the area where the conveyor belt 13 of the first conveyor 1 meets the conveyor belt 23 of the second conveyor 2, the both belts move in the same direction, i.e., to the left in FIG. 1.

If the conveyor belt 13 of the first conveyor 1 and the conveyor belt 23 of the second conveyor 2 move at the same speed, their relative movement speed is zero. Accordingly, by synchronizing the conveying speeds of the conveyor belts 13 and 23 so as to match the positions of their recesses, the tablets T can be smoothly transferred from the first conveyor 1 to the second conveyor 2.

In the first embodiment, the first pulley 11 of the first conveyor 1 and the first pulley 21 of the second conveyor 2 are positioned such that their axes are aligned in the vertical direction. Therefore, the tablets T are transferred at the position (position d in FIG. 1) where the conveyor belt 13 comes in contact with the first pulley 11 of the first conveyor 1 and the conveyor belt 23 separates from the first pulley 21 of the second conveyor 2.

However, the positional relationship between the first pulley 11 of the first conveyor 1 and the first pulley 21 of the second conveyor 2 is not limited to the one as described in the first embodiment. The positions of the pulleys may not be aligned. That is, the first pulley 21 of the second conveyor 2 may be shifted to the right in FIG. 1 from the first pulley 11 of the first conveyor 1 such that the conveyor belt 13 of the conveyor 1 and the conveyor belt 23 of the conveyor 2 horizontally face each other. The tablets T are transferred at the portion where the conveyor belts 13 and 23 overlap.

When the conveyor belt 23 is viewed from above, the tablets transferred from the first conveyor 1 to the second conveyor 2 are each housed in the recess 131 of the second conveyor belt 23 in a state where the surface having a print generated by the first printer 3 faces the bottom of the recess 131 (see FIG. 3) and the opposite surface faces up.

Similarly to the suction chamber 14 described above, the suction chamber 24 is arranged inside the conveyor belt 23 over the entire circumference thereof, and is configured to be able to apply a suction force to the suction portions (not illustrated) of the conveyor belt 23.

The second conveyor 2 has the structure as described above. The second printer 4 is arranged above the second conveyor 2 to face it as illustrated in FIG. 1. That is, the second printer 4 is arranged to face an area where the conveyor belt 23 travels from the first pulley 21 to the second pulley 22 (the upper horizontal area of the conveyor belt 23 between positions e and f in FIG. 1).

As with the first printer 3, the second printer 4 includes a print head H that performs printing on the tablets T, a position detecting device (detector) 42 located upstream of the print head H in the traveling direction of the conveyor belt 23, and a print condition checking device (tester) 43 located downstream of the print head H in the traveling direction of the conveyor belt 23.

The position detecting device 42 includes an imaging device (imager) 421 that photographs each of the tablets T and an illumination 422 that illuminates the tablet T to be photographed. The print condition checking device 43 includes an imaging device (imager) 431 that photographs the print condition on each of the tablets T and an illumination 432 that illuminates the tablet T to be photographed. As in the first printer 3, the imaging device 431 and the illumination 432 are also controlled by the controller 5.

In addition, a drying device (dryer) 25 is arranged below the second conveyor 2 to dry ink applied to the tablets T after printing. That is, the drying device 25 is arranged to face an area where the conveyor belt 23 travels from the second pulley 22 to the first pulley 21 (the area between positions g and h in FIG. 1).

As in the case of the arrangement position of the drying device 16 described above, the drying device 25 may be located in any position as long as it can dry ink applied to the tablets T without interfering with other mechanisms of the tablet printing apparatus S.

On the downstream side of the drying device 25 of the second conveyor 2, there are provided boxes 26 and 27 for collecting the tablets T printed on both sides according to their print quality. The controller 5 determines whether a print on each tablet is defective or acceptable based on the checking result received from the print condition checking devices 33 and 43.

For example, when the print condition is determined to be acceptable, the tablet T is sent as a non-defective product from the conveyor belt 23 to the non-defective product collection box 26. On the other hand, if the print condition is determined to be defective, the tablet is sent as a defective product from the conveyor belt 23 to the defective product collection box 27. As an example of the defective product collector, air may be blown against the defective tablet T that is falling from the conveyor belt 23 to the non-defective product collection box 26 so as to store it in the defective product collection box 27.

The controller 5 controls each unit of the tablet printing apparatus S. Although not illustrated in FIG. 1, the controller 5 may be connected to, for example, an input unit for inputting various types of print information and the like, and a display that displays input results, print results, and the like. In the above, only each part of the printing unit P illustrated in FIG. 1 is described as being electrically connected to the controller 5. However, the controller 5 controls every part of the tablet printing apparatus S as described above, and therefore other parts are also electrically connected to the controller 5.

Printing Process

With reference to FIG. 1, a description will be given of printing process performed on the tablets T using the tablet printing apparatus S step by step.

First, the tablets T stored in the tablet supply device 15 are sequentially supplied to the first pulley 11 of the first conveyor 1 which is rotating clockwise. The tablets T supplied from the tablet supply device 15 are sequentially housed one by one in the recesses 131 of the conveyor belt 13.

The tablets T are supplied from the tablet supply device 15 at the position as illustrated in FIG. 1. As the suction chamber 14 applies a suction force to the suction portions 130, the tablets T are sucked and held in the recesses 131 without falling. Incidentally, the term "sucked and held" as used herein means that the tablets T are held by suction.

The tablets T are sequentially conveyed while being held in the recesses 131 of the conveyor belt 13 by the suction chamber 14. Then, a character, a letter, a figure, or the like is printed on the upper surface of each of the tablets T by the first printer 3 located above the first conveyor 1. The character, the letter, the figure, or the like are set in advance.

In concrete terms, at the beginning, the position detecting device 32 checks the position of each of the tablets T in one of the recesses 131 of the conveyor belt 13. The imaging device 321 captures an image of the tablet T and the recess 131, and sends it to the controller 5. The controller 5 obtains (detects) the posture information such as the position, orientation, and front/back of the tablet T based on the image. The controller 5 then drives the print head H so as to perform appropriate printing (if the position of the tablet T has shifted, the controller 5 performs processing so as to correct the position shift or adjust the orientation, and performs printing) based on the detection result. The controller 5 also determines whether to perform printing.

When it is required to determine the orientation of the tablets T before printing as in the case where it has a split line or it has a triangular or rectangular outer shape, the orientation of the tablet T may also be detected in addition to its position.

Having determined that the tablet T is located in a position where printing cannot be applied and thus printing is not possible, the controller 5 performs the process in such a manner as to let the tablet T pass through under the first printer 3 without printing. On the other hand, when it is determined that the tablet T is located in a printable position and that printing is possible, the tablet T is conveyed by the conveyor belt 13 to under the print head H.

The print head H performs printing on the upper surface of the conveyed tablet T according to an instruction from the controller 5. Upon completion of the printing, the tablet T moves to under the print condition checking device 33 as being conveyed.

At the print condition checking device 33, the imaging device 331 captures an image of the conveyed tablet T, and sends it to the controller 5. The controller 5 determines whether the print condition is acceptable based on the information received from the imaging device 331.

Thereafter, the tablet T is reversed by the second pulley 12 while being housed in the recess 131 of the conveyor belt 13, and moves from the upper side to the lower side of the first conveyor 1.

The ink applied to one surface of the reversed tablet T is dried by the drying device 16 that is arranged in a position where the conveyor belt 13 moves leftward in FIG. 1 from the second pulley 12 to the first pulley 11 (between the positions c and d in FIG. 1). The tablet having the ink dried is transferred from the first conveyor 1 to the second conveyor 2.

In the second conveyor 2, printing is performed on the unprinted surface of the tablet T. The flow of printing is the same manner as described above. After the position detecting device 42 checks the position of the tablet and the print head H performs printing T, the print condition is checked based on information acquired by the print condition checking device 43.

The drying device 25 dries the ink on the tablet T after the printing is completed in the lower horizontal area of the conveyor belt 23. At this time, the surface of the tablet T having a print generated by the second printer 4 faces the drying device 25. The ink is dried while the conveyor belt 23 is moving from the second pulley 22 to the first pulley 21.

The dried tablet T is collected to be stored in the collection box 26 or 27. Specifically, if the controller 5 determines that the print has been properly applied to the tablet T based on check results from the print condition checking devices 33 and 43, the tablet T is stored in the non-defective product collection box 26. On the other hand, if the controller 5 determines that the print is inappropriate, the tablet T is stored in the defective product collection box 27.

With this, the printing process for the tablets T ends.

Suction Chamber

Next, the structure of the conveying device C, particularly, the structure of the suction chamber 14 (24) will be described in detail with reference to FIGS. 3 and 4. Since the suction chambers 14 and 24 have the same structure, the suction chamber 14 of the first conveyor 1 will be described below as an example.

In the first embodiment, a suction force adjustment device (adjuster) and the suction force adjustment method are constituted by elements, suction method, or the like, related to suction described below.

Figure 4:
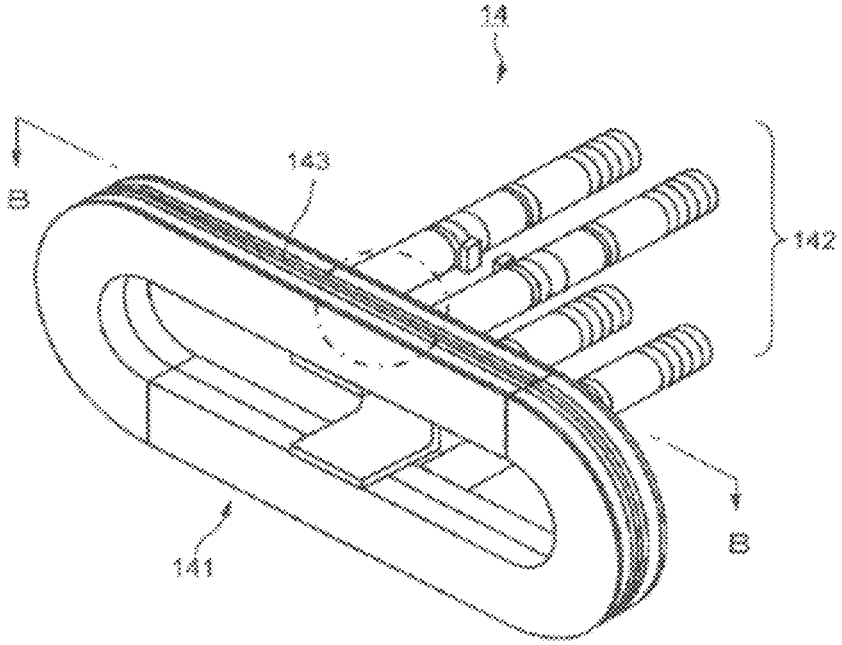
FIG. 4 is a perspective view of a suction chamber illustrated in FIG. 1 for illustrating the overall configuration thereof.

FIG. 4 is a perspective view of the suction chamber 14 of the first embodiment for illustrating the overall configuration thereof. In FIG. 4, the suction chamber 14 is illustrated as being oriented in substantially the same direction as the first conveyor illustrated in FIG. 2. That is, although not illustrated in FIG. 4, the first pulley 11 is present on the left rear side, and the second pulley 12 is present on the right front side in FIG. 4.

As illustrated in FIG. 4, the suction chamber 14 includes a chamber main body 141 and a suction path 142 which is connected to a pump (not illustrated) to perform suction. The chamber main body 141 is connected to the pump through the suction path 142.

As illustrated in FIGS. 3 and 4, the chamber main body 141 is provided with a suction groove 143 that extends over the entire outer periphery of the chamber main body 141 as a suction part (sucker) for sucking air. The suction groove 143 is located just under the suction holes 132 of the conveyor belt 13 that is wrapped around the first pulley 11 and the second pulley 12. Accordingly, when air is sucked from the chamber main body 141 through the suction path 142, air is sucked from the suction groove 143, the suction holes 132 of the conveyor belt 13 and the recesses 131 of the conveyor belt 13. Thereby, suction force is applied to (exerted on) or acts on the tablets T in contact with the recesses 131.

In this manner, the suction chamber 14 applies a suction force to the tablets T housed in the recesses 131 of the conveyor belt 13 through the suction holes 132 of the conveyor belt 13 to suck and hold the tablets T. Accordingly, the suction chamber 14 is configured to be able to apply a suction force to the suction portions 130 over the entire circumference of the conveyor belt 13.

Although the suction chamber 14 is capable of applying a suction force to the suction portions 130 over the entire circumference of the conveyor belt 13, the suction force need not necessarily be applied to the entire circumference. In other words, as described later, there may be a part where suction force is not applied, and the part where the suction force is to be applied can be selectively set. Further, the suction force can be varied depending on the areas of the circumference.

Besides, although the suction chamber 14 is described above as being connected to one pump, it may be connected to, for example, a plurality of pumps through the suction path 142. When connected to different pumps, the suction chamber 14 can apply different levels of suction force to the suction holes 132 formed over the entire circumference of the conveyor belt 13 by dividing the circumference of the conveyor belt 13 into a plurality of areas as described later. So that the suction chamber 14 can suck and hold the tablets T that are conveyed as being held on the conveyor belt 13 with a desired suction force according to their positions (conveyed positions) on the conveyor belt 13.

Figure 5:
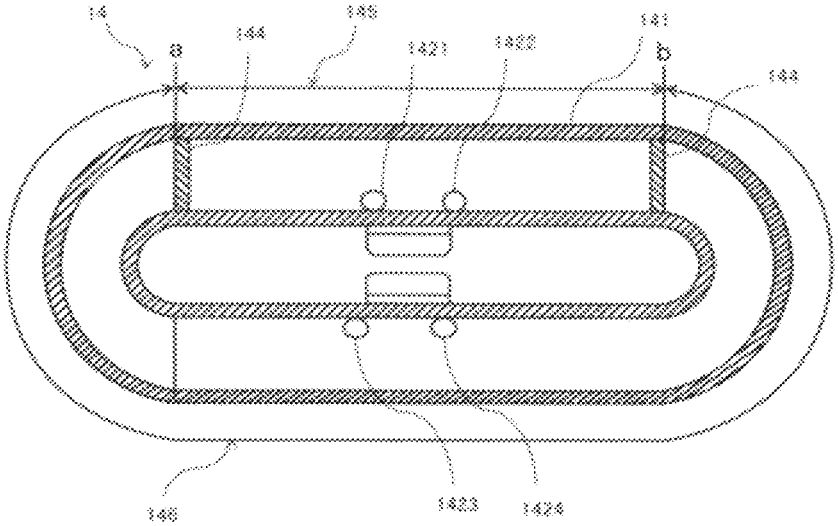
FIG. 5 is a cross-sectional view of the suction chamber taken along the line B-B in FIG. 4.

FIG. 5 is a cross-sectional view of the suction chamber 14 taken along the line B-B in FIG. 4. As illustrated in FIG. 5, two partition walls 144 are formed inside the chamber main body 141 of the suction chamber 14 to divide the inside into two compartments.

As illustrated in FIG. 5, the partition walls 144 are formed at the positions a and b in FIG. 1. That is, the inside of the chamber main body 141 is divided by the partition walls 144 into a first compartment 145 located between the positions a and b in FIG. 1 and another compartment as a second compartment 146. The first compartment 145 is connected to suction paths 1421 and 1422, while the second compartment 146 is connected to suction paths 1423 and 1424.

As described above, the two compartments 145 and 146 are separated by the partition walls 144, and each of them is provided with the suction paths 142 (1421 to 1424). Accordingly, air does not circulate between the compartments. With this, the level of suction force (the suction pressure, the amount of air sucked, the speed of air suction) can be varied depending on the compartments to suck air.

As the suction chamber 14 sucks air through the suction holes 132, the tablets T, which are conveyed as being housed in the recesses 131 of the conveyor belt 13, are sucked and held in the recesses 131. In other words, the tablets T are sucked and held in the suction portions 130 of the conveyor belt 13 by the suction force of the suction chamber 14.

At this time, some of the suction holes 132 may be closed by the tablets T and some may not. Specifically, the suction hole 132 may not be completely closed by the tablet T depending on the size and shape of the tablet T, or the posture of the tablet T in the recess 131, and the like. If the suction hole 132 is not completely closed by the tablet T, a space where air is sucked from the suction hole 132 toward the suction chamber 14 is created around the contact position between the suction hole 132 and the tablet T. In such a case, as the tablet T is sucked and held through the suction hole 132, the air around the tablet T is sucked from above and side of the tablet T through the suction hole 132.

In particular, when the suction force of the suction chamber 14 is strong, an increased amount of air is sucked, and the sucked air flows at a higher speed. This may result in the generation of stronger airflow around the tablet T, an increase in the range of the reach of the airflow, or the turbulence of the airflow.

In the tablet printing apparatus S, the printing unit P includes the inkjet print head H. In the case of inkjet printing, ink is ejected from the print head H toward the tablets T to be printed, and a print is made by the ink that has landed on the surface of each tablet T. The ink is flying between the print head H and the tablet T after being ejected from the print head H until it lands on the surface of the tablet T.

At this time, if an airflow is generated in the space between the print head H and the tablet T, droplets of the ink ejected from the print head H and flying may be deformed due to the airflow, or a landing position of the ink may sift form a desired position as its flying direction is affected by the airflow. This causes printing defects and a reduction in print quality. There may be no problem as long as the airflow does not affect the print quality. However, if the airflow is strong and reaches a wide range, or the airflow is turbulent, the print quality is significantly reduced. Besides, if the influence of the airflow reaches around the nozzles of the print head H for ejecting the ink, the ink around the nozzles dries. This causes ejection failure, resulting also in a reduction in print quality. Further, the ink which has not landed on the tablets T may scatter like mist. If the ink scatters like mist, for example, it is sucked together with the air by the suction chamber and adheres to the side surface of the tablets T being conveyed.

Therefore, in the tablet printing apparatus S of the first embodiment, less suction force is applied to the tablets T during printing to reduce the amount and flow rate of air to be sucked so that printing defects due to airflow or mist can be reduced as much as possible. Specifically, the suction force applied to the tablets T is reduced at least while the tablets T are located in the printing position where the print head H performs printing compared to that applied to those in other locations on the conveyor belt 13.

Besides, as described above, after the print head H performs printing based on the posture information of the tablet T obtained by the position detecting device 32, the print condition checking device 33 also uses the data obtained by the position detecting device 32 to check the print condition and determine whether the printing has been performed properly. Therefore, if the holding state of the tablet T has changed on the conveyor belt 13 between when the position detecting device 32 detects the posture information of the tablet T and when the print head H performs printing on the tablet T, print misalignment may occur. Further, if the holding state of the tablet T has changed on the conveyor belt 13 between when the print head H performs printing on the tablet T and when the print condition checking device 33 checks the print condition, the defect rate becomes high in the check result of the print condition. For example, assuming that the defect rate increases by 1% when printing is performed on 300,000 tablets per hour, defective tablets increase by 3000 per hour. Therefore, considering one tablet conveyed by the conveyor belt 23, the tablet T has to be in the same state (posture, etc.) on the conveyor belt 13 in at least three places: the detection position where the position detecting device 32 detects the tablet T; the printing position where the print head H performs printing on the tablet T; and the check position where the print condition checking device 33 checks the print condition on the tablet T. Meanwhile, if the suction force changes significantly while the tablet T is being conveyed by the conveyor belt 13, the position of the tablet T may shift or tablet T becomes shaky, and as a result, its posture may change. The tablet T may even fall from the conveyor belt 13. For this reason, in the tablet printing apparatus S of the first embodiment, the suction force applied to the tablets T is reduced at least in an area including the printing position where the print head H performs printing on the tablets T, from the detection position where the position detecting device 32 detects each of the tablets T to the check position where the print condition checking device 33 checks print condition on the tablets T, as compared to that applied to tablets T in other areas on the conveyor belt 13.

If the suction force applied to the tablets T is suddenly reduced at the point the tablets T reach the defection position where the position detecting device 32 detects each of the tablets T, or it is suddenly increased at the point the tablets T pass the check position where the print condition checking device 33 checks print condition on the tablets T, the position of the tablets T is likely to shift due to changes in pressure. Therefore, it is preferable that the area where the tablets T are conveyed by the conveyor belt 13 as being sucked with reduced suction force be between an arbitrary position (conveyed position) that is upstream of the detection position where the position detecting device 32 detects the tablets T (a predetermined position before the detection position) and an arbitrary position (conveyed position) that is downstream of the check position where the print condition checking device 33 checks print condition on the tablets T (a predetermined position behind the check position). Incidentally, the area where the tablets T are conveyed by the conveyor belt 13 as being sucked with reduced suction force is located downstream of the position where the tablets T are supplied to the conveyor belt 13. In this embodiment, the area between the positions a and b in FIG. 1 corresponds to the area where the tablets T are sucked with reduced suction force to be held on the conveyor belt 13.

In the area of the conveyor belt 13 conveying the tablets T, the area where the tablets T are sucked with reduced suction force to be held on the conveyor belt 13 is referred to as "first area" for the sake of convenience. Referring to the above, the first area is between the positions a and b in FIG. 1. This area includes an area from the detection position where the position detecting device 32 detects each of the tablets T to the check position where the print condition checking device 33 checks print condition on the tablets T.

While the suction chamber 14 applies a suction force to the suction portions 130 over the entire circumference of the conveyor belt 13, the suction force need not be particularly reduced in other areas than the first area since there is no need to consider its influence on the ink flying at the time of printing. The suction force is only required to be larger than the self-weight of the tablet T and the centrifugal force generated during conveyance as described below. Of the entire circumference of the conveyor belt 13, other areas than the first area are collectively referred to as "second area" for the sake of convenience. The second area includes, for example, an area where the tablets are sucked and held against the self-weight and the centrifugal force, or an area from where the tablets are supplied from the tablet supply device to the conveying device to the check position where print condition on the tablets T is checked, except for the first area, in the entire circumference of the conveyor belt 13.

The first area corresponds to the first compartment 145 in the suction chamber 14. Meanwhile, the second area corresponds to the second compartment 146 in the suction chamber 14. Since each of the compartments is provided with the independent suction paths 142, the suction force of the first compartment 145 to be applied to the tablets T can be set less than that of the second compartment 146.

As described above, according to the first embodiment, in the suction chamber 14, the suction force of the first compartment 145 corresponding to the first area can be set less than that of the second compartment 146 corresponding to the second area. Thereby, it is possible to reduce the suction force applied to the tablets T passing under the print head H for printing. By regulating the suction chamber 14 in this manner, required suction force can be applied to the tablets T in each process performed in the tablet printing apparatus S.

In particular, reduced suction force is applied to the tablets T passing under the print head H than in other areas (second area) on the conveyor belt 13. As a result, airflow that causes a reduction in print quality is prevented from occurring around the tablets T or in the space between the tablets T and the print head H. Thus, it is possible to prevent printing defects and a reduction in print quality due to airflow that may cause deformation of droplets of ink ejected from the print head H and flying or may influence the flying direction of the ink droplets resulting in misalignment of the landing position of the ink. Besides, it is possible to prevent ejection failure due to drying the ink near nozzles of the print head H for ejecting ink by influence of airflow reaching around the nozzles. Thus, reduction in print quality can be prevented. In addition, the ink which has not landed on the tablets T is prevented from scattering like mist and adhering to the side surface of the tablets T being conveyed.

In the second area, the suction force needs to be large enough to prevent the tablets T from falling from the conveyor belt 13, and it must be considerably larger than the suction force that is just sufficient to prevent the tablets T from shifting. Therefore, the suction of air for sucking and holding tablets is properly regulated to ensure the stable ejection of ink. Thus, the print quality can be maintained in the tablet printing apparatus S and the method thereof.

Further, reduced and uniform suction force (same suction force) is applied to the tablets T at least in an area including the printing position where the print head H performs printing on the tablets T, from the detection position where the position detecting device 32 detects each of the tablets T to the check position where the print condition checking device 33 checks print condition on the tablets T, as compared to that applied to those in other areas on the conveyor belt 13. With this, the tablets T are kept in the same posture (in the same state) without shifting relative to the conveyor belt 13 in at least three places: the printing position where the print head H performs printing on the tablets T; the detection position where the position detecting device 32 detects each of the tablets T; and the check position where the print condition checking device 33 checks the print condition on the tablets T. Thus, print misalignment and an increase in defect rate can be prevented for the same reason as described above. Incidentally, in the above example, the suction force applied to the tablets T at least in an area from the detection position where the position detecting device 32 detects each of the tablets T to the check position where the print condition checking device 33 checks print condition on the tablets T is described as being at the same pressure; however, it may be gradually changed so as not to cause the posture or the like of the tablets T to change relative to the conveyor belt 13 by, for example, using the method described later in a second embodiment.

Modifications

The above description has been made assuming that the inside of the suction chamber 14 is divided into the two compartments 145 and 146 to apply two levels of suction force. However, the number of levels of suction force applied to the tablets T is not limited to two, and the level of suction force may be adjusted for each process performed in the tablet printing apparatus S. In this case, two or more levels of suction force are properly applied to the tablets T.

For example, as described above, the suction force that can reliably hold the tablets T needs to be applied to the tablets T sucked and held on the conveyor belt 13 in any of an upper area where printing is performed between the first pulley 11 and the second pulley 12 of the first conveyor 1 (an area between the positions a and b in FIG. 1), a lower area toward the second conveyor 2 (an area between the positions c and d in FIG. 1), and an area rotating in the circumferential direction of the second pulley 12 between the upper and lower areas (an area between the positions b and c in FIG. 1). Specifically, a suction force that prevents the tablets T from shifting or shaking during conveyance is required in the upper area. Meanwhile, a suction force that prevents the tablets T from falling is required in the lower area, and a suction force that counteracts against the centrifugal force as well as preventing the tablets T from falling is required in the area rotating in the circumferential direction of the second pulley 12. In addition, at (and around) the position where printing is performed in the upper area, the suction force needs to be prevented from affecting the printing.

Therefore, for example, the inside of the chamber main body 141 may be divided into a plurality of compartments so that different levels of suction force can be assigned to them. Specifically, a suction force that prevents the tablets T from falling is assigned to the lower compartment of the suction chamber 14, while a suction force that counteracts against the centrifugal force as well as preventing the tablets T from falling is assigned to the compartment at the position where the tablets T move in the circumferential direction of the second pulley 12. With this, the tablets T can be more appropriately sucked and held on the first conveyor 1. Although the lower compartment and the compartment located around the second pulley 12 are required to produce a suction force considerably larger than the suction force of the upper compartment that does not affect printing but is sufficient to prevent the tablets T from shifting or shaking during conveyance, an optimal suction force can be properly applied to the tablets T in each process (at each location where the tablets T are conveyed). This also applies to the second conveyor 2.

In other words, the upper compartment (area) of the suction chamber 14, which is assigned a reduced suction force as described above, corresponds to the first area, and other compartments (parts) of the suction chamber 14, i.e., the lower compartment and the compartment located around the second pulley 12, correspond to the second area. While the lower compartment and the compartment (part) located around the second pulley 12 may be assigned different levels of suction force, their suction force is set larger than that of the upper compartment.

As described above, the suction force is reduced during printing so as not to generate an airflow that causes printing defects as compared to the suction force sufficient to ensure that the tablets T are sucked to be held on at any position on the conveyor belt 13 even if airflow is generated around the tablets T on the conveyor belt 13 due to the suction. Since printing is performed in the upper area between the first pulley 11 and the second pulley 12 of the first conveyor 1, the tablets T are supported by the conveyor belt 13. Therefore, even if the suction force is reduced in the upper area than in other areas, it does not affect the conveyance.

In one example of the first embodiment described above, the suction chamber 14 applies a suction force to the suction portions 130 over the entire circumference of the conveyor belt 13. In the following, another example will be described in which no suction force is applied to a part of the circumference of the conveyor belt 13.

Figure 6:
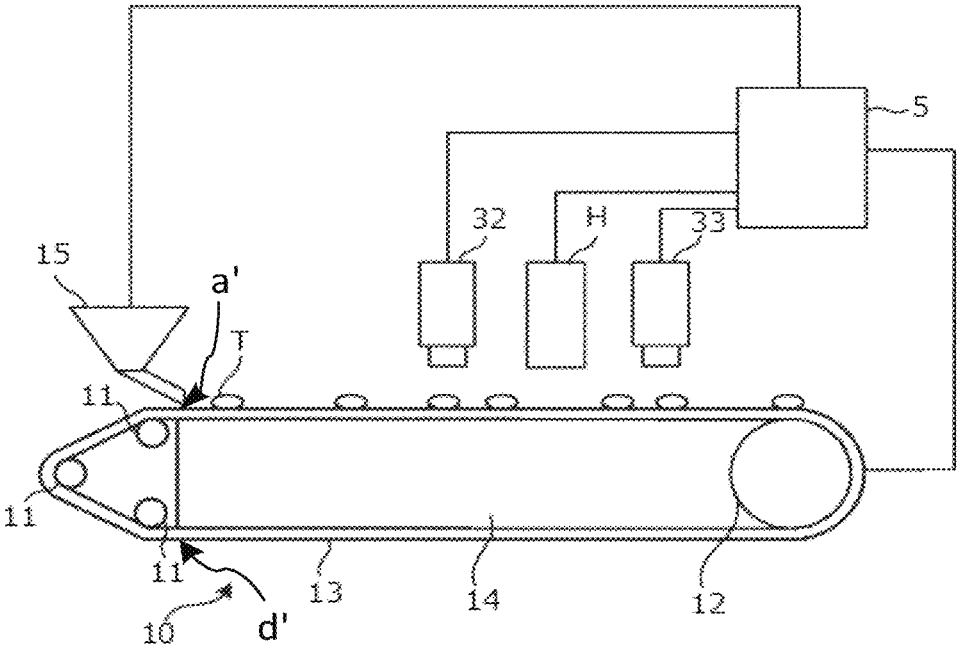
FIG. 6 is a front view of another example of the tablet printing apparatus of the first embodiment for illustrating the overall configuration thereof.
Figure 7:
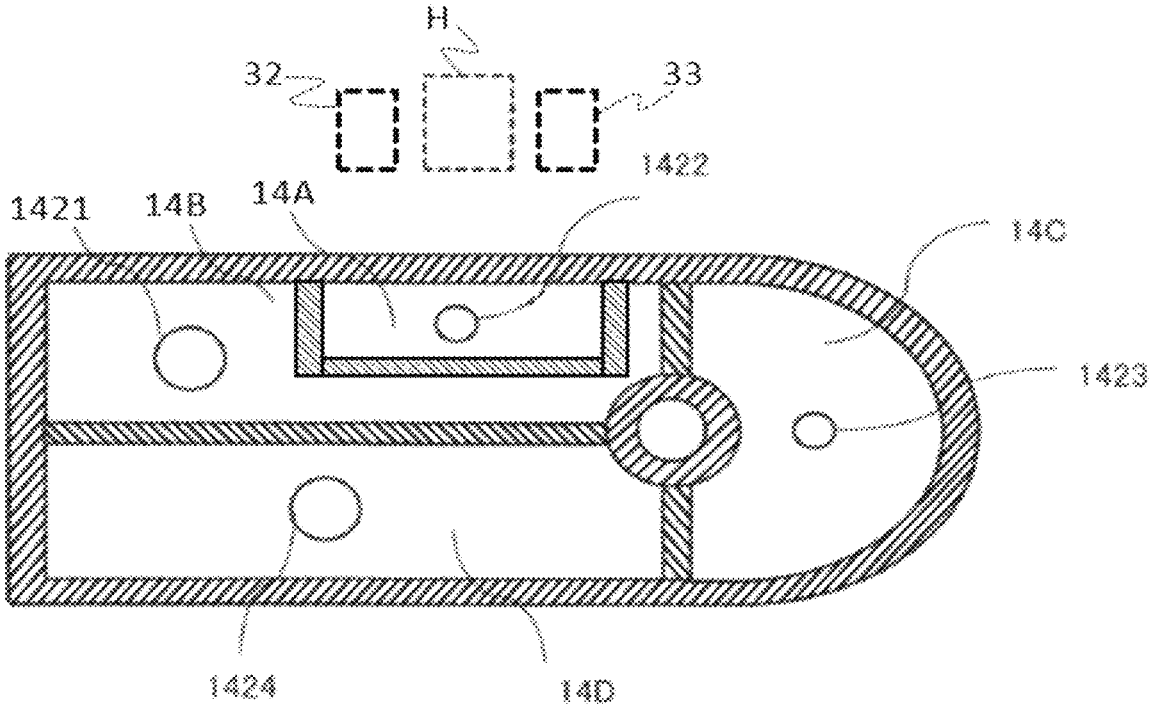
FIG. 7 is a cross-sectional view of the suction chamber illustrated in FIG. 6, and corresponds to FIG. 5.

FIG. 6 is a front view of another example of the tablet printing apparatus of the first embodiment for illustrating the overall configuration thereof. FIG. 7 is a cross-sectional view of the suction chamber illustrated in FIG. 6, and corresponds to FIG. 5. Like reference numerals designate like or corresponding parts as those previously described with reference to FIGS. 1 to 5, and the same description is not repeated. FIG. 6 illustrates a part corresponding to the first conveyor 1 and the first printer 3 illustrated in FIG. 1. If two sets of the conveying device and the printing unit illustrated in FIG. 6 are arranged one above the other in the same manner as illustrated in FIG. 1, printing can be performed on both sides of the tablets.

In a tablet printing apparatus 10 illustrated in FIG. 6, a plurality of first pulleys 11 are arranged such that the end of the suction chamber 14 on the first pulleys 11 side is located at a position where the tablets T are supplied from the tablet supply device 15. In FIG. 6, the upper and lower end points of the suction chamber 14 on the first pulleys 11 side are denoted by a' and d', respectively. In an area between the points d' and a', the tablets T are not sucked and held, which means there is no need to apply a suction force in this area. Therefore, this area can be an area where no suction force is applied at all. In a conveying device that conveys tablets while sucking and holding them, an area where no suction force is applied such as, for example, the area between the points d' and a' in this embodiment, does not fall within the definition of the "other areas" as used herein. In this embodiment, for example, there may further be provided a compartment 14A, which corresponds to an area including the printing position where the print head H performs printing on the tablets T, from a position in front of the detection position where the position detecting device 32 detects each of the tablets T to a position just behind the check position where the print condition checking device 33 checks print condition on the tablets T, in the upper part of the suction chamber 14 as illustrated in FIG. 7. In this case, the compartment 14A is assigned a suction force that does not affect printing, while an upper compartment 14B that surrounds the compartment 14A is assigned a suction force that does not affect the conveyance. As described above, the suction chamber 14 may be further divided to form a compartment 14C around the second pulley 12 and a lower compartment 14D.

Besides, in the first embodiment illustrated in FIGS. 1 and 6, the tablets T are shaking after being transferred from the tablet supply device 15 to the first conveyor 1 or from the first conveyor 1 to the second conveyor 2. If the tablets T are shaking, accurate position detection and printing cannot be performed. For this reason, it is preferable that a larger suction force be applied in a position near where the tablets T are transferred on the receiver side. The larger suction force can stop the shaking of the tablets T quickly. That is, in the upper part of the suction chamber 24 of the second conveyor 2, there may further be provided a compartment that corresponds to the area where the tablets T are transferred. In this case, the compartment is assigned a suction force that can stop the shaking of the tablets T quickly.

As described above, there can be provided as many compartments as necessary in desired parts. In other words, the first and second compartments (areas) of the suction chamber 14 can be further divided into compartments, and the suction force of each of them can be set appropriately.

Incidentally, there is a change in the level of suction force at the border between compartments each assigned a different level of suction force. If the change is large, the tablets T may shift, shake, or fall from the belt. Therefore, there may be provided a compartment in front of and behind the compartment with the necessary suction force so as to moderate the change in suction force. This enables the gradual change of the suction force across the compartments, thereby suppressing the tablets T from shifting, shaking, or falling from the belt.

Second Embodiment

Next, a second embodiment will be described with reference to FIGS. 8 to 15. In the second embodiment, like reference numerals designate like or corresponding parts as those of the first embodiment, and the same description is not repeated.

In the first embodiment described above, less suction force is applied to the tablets T in the first area where printing is performed than in the second area other than the first area. This prevents the generation of mist and the occurrence of printing defects due to airflow caused by the suction of air in the suction portions 130.

On the other hand, in the second embodiment, the suction force applied to the tablets T in the first area is reduced without varying the level of suction force generated by the suction chamber 14. How to implement this will be described with reference to FIGS. 8 and 9.

Note that the suction force generated by the suction chamber 14 refers to a suction force, for example, that is generated in the suction groove 143 formed in the suction chamber 14 by discharging air from the suction chamber 14, and is determined by the amount of air to be discharged and the discharge speed. The suction force generated in the suction groove 143 acts on the tablets T through a conveyor belt 133, thereby pulling the tablets T onto the conveyor belt 133. The pulling force is the suction force applied to the tablets T. Accordingly, in the second embodiment, the suction force that acts on the tablets T on the conveyor belt 133 is reduced without changing the amount of air to be discharged from the suction chamber 14 and the discharge speed.

Figure 8:
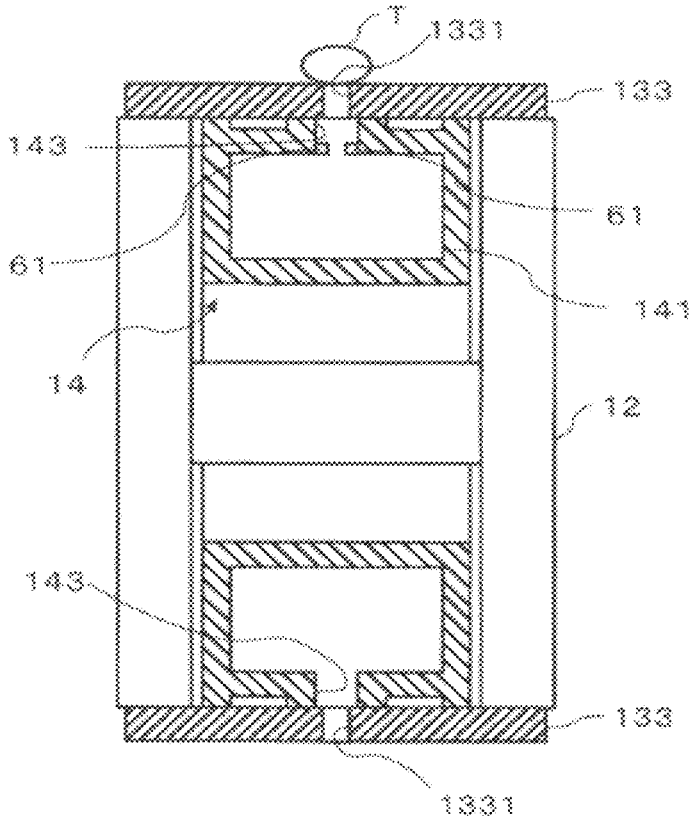
FIG. 8 is a cross-sectional view of a tablet printing apparatus according to a second embodiment taken along the line A-A in FIG. 1.

FIG. 8 is a cross-sectional view of a tablet printing apparatus S of the second embodiment taken along the line A-A in FIG. 1. The left side in FIG. 8 corresponds to the front side of the first conveyor 1 illustrated in FIG. 1. Note that the second pulley 12 is not cross-sectionally cut in FIG. 8.

In FIG. 8, the upper side of the second pulley 12 (above the rotation axis) corresponds to the position where the conveyor belt 133 comes in contact with the second pulley 12 after the tablets T on the conveyor belt 133 are printed by the first printer 3 and pass under the print condition checking device 33, i.e., the position b in FIG. 1. On the other hand, the lower side of the second pulley 12 (below the rotation axis) corresponds to the position where the conveyor belt 133 separates from the second pulley 12 after the tablets T thereon are reversed according to rotating of the second pulley 12, and where the drying device 16, which is located in a position facing the conveyor belt 133, starts drying, i.e., the portion c in FIG. 1.

As illustrated in FIG. 8, the conveyor belt 133 has a groove 1331 in an area opposite to the suction groove 143 formed in the suction chamber 14, and is not provided with the recesses 131 as in the conveyor belt 13 of the first embodiment. The left and right sides (in FIG. 8) of the groove 1331 are joined at intervals in a ladder fashion. When this groove 1331 is formed circumferentially in the conveyor belt 133, airflow tends to occur due to suction as compared to the case of the recesses 131 as in the conveyor belt 13 of the first embodiment. This is because air is sucked through parts of the groove 1331 where there are no tablets T sucked and held, and airflow is always present around the tablets T.

The suction groove 143 is provided with a suction force lowering member 61. The suction force lowering member 61 is a suction force adjustment device (adjuster) for reducing airflow caused by suction. The suction force lowering member 61 is made of, for example, a flange-shaped member, and is arranged so as to close part of the suction groove 143 at the boundary between the suction groove 143 and the chamber main body 141 of the suction chamber 14. The suction force lowering member 61 is located in a position facing the conveyor belt 133, and is formed so as to project from both sides of the suction groove 143.

Figure 9:
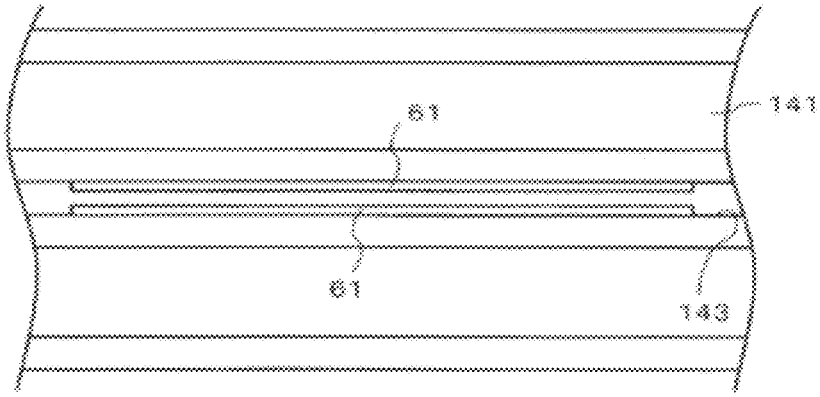
FIG. 9 is an enlarged plan view of a suction force lowering member of the second embodiment.

FIG. 9 is an enlarged plan view of the suction force lowering member 61 of the second embodiment provided for the first area. Specifically, FIG. 9 is an enlarged view of a portion encircled by a chain line in FIG. 4 that illustrates an overall view of the suction chamber 14.

In the enlarged view of FIG. 9, the suction groove 143 is illustrated in the center thereof, and the suction force lowering member 61 is arranged so as to close part of the suction groove 143. That is, the suction force lowering member 61 is formed so as to project from both sides of the suction groove 143 in a range corresponding to the first area. For example, the suction force lowering member 61 projects the same width from both sides of the suction groove 143. With the suction force lowering member 61 formed in this manner, air is sucked from the center of the suction groove 143. Thus, even if the suction force applied to the tablets T is reduced, the tablets T can be sucked to be held without disturbance in their posture and the like.

As described above, according to the second embodiment, the suction force lowering member 61 is arranged in the suction groove 143 of the suction chamber 14 to narrow the groove width (opening width) of the suction groove 143. This regulates the amount of air that can pass through the suction groove 143 by the suction force of the suction chamber 14. As a result, the amount of air that pulls the tablets T decreases, and thus the suction force applied to the tablets T decreases.

In particular, as the suction force lowering member 61 is arranged in a position corresponding to the first area, the suction force is reduced in the first area. Thereby, less (reduced) suction force can be applied to the tablets T in the first area than in the second area as a necessary suction force for the tablet T. As a result, airflow is prevented from occurring around the tablets T, and the suction of air is prevented from affecting printing. Thus, it is possible to prevent printing defects and a reduction in print quality due to airflow that may cause deformation of droplets of ink ejected from the print head H and flying or may influence the flying direction of the ink droplets resulting in misalignment of the landing position of the ink. Besides, it is possible to prevent ejection failure due to drying the ink near nozzles of the print head H for ejecting ink by influence of airflow reaching around the nozzles. Thus, reduction in print quality can be prevented. In addition, the ink which has not landed on the tablets T is prevented from scattering like mist and adhering to the side surface of the tablets T being conveyed.

The suction force lowering member 61 may be located at any position in the suction groove 143 as long as it does not contact the conveyor belt 133. The suction force lowering member 61 need not necessarily be located in the suction groove 143, but may be arranged in any position as long as it can regulate the amount of air passing through the suction groove 143 to reduce the suction force that acts on the tablets T through the conveyor belt 133. Alternatively, there may be provided another member.

As described above, the suction force of the suction chamber 14 can be regulated by how far the suction force lowering member 61 projects from both sides of the suction groove 143. Therefore, the size of the suction force lowering member 61 is determined according to the level of suction force applied to the tablets T in the first area.

On the other hand, the lower side of the second pulley 12 (below the rotation axis) corresponds to the second area, i.e., the second compartment 146 in the suction chamber 14, where there is no need to reduce the suction force to be applied. Accordingly, at the boundary between the suction groove 143 and the chamber main body 141, which corresponds to the second compartment 146, there is no suction force lowering member 61 to close part of the suction groove 143. The suction force of the suction chamber 14, the width of the suction groove 143, and the like are appropriately determined so that the tablets T can be imparted a suction force that ensures that they are reliably held during conveyance.

Modifications

The suction force lowering member 61, which is arranged at the boundary between the suction groove 143 and the chamber main body 141, has been described above with reference to FIGS. 8 and 9. Although the suction force lowering member 61 is a flange-shaped member, another type of member can also be used if it can produce the same effect as that of the suction force lowering member 61. The level of suction force to be applied to the tablets T can be set freely by the size, the shape, and the number of openings formed in a plate-shaped member serving as the suction force lowering member 61.

Figure 10:
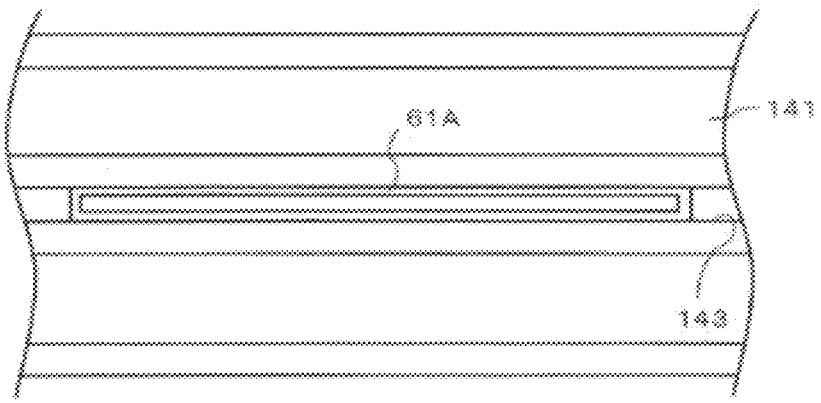
FIG. 10 is an enlarged plan view of another example of the suction force lowering member of the second embodiment.

For example, a suction force lowering member 61A having a rectangular cylindrical shape (rectangular frame shape) as illustrated in FIG. 10 can be used as a modification of the suction force adjustment device. This structure of the frame-shaped suction force lowering member 61A can eliminate the influence of airflow coming therein from the upstream side and the downstream side in the conveying direction of the tablets T (the influence of airflow by suction on the upstream side and the downstream side). Thereby, the influence of the airflow can be more reliably suppressed. In other words, it is possible to more reliably adjust the amount of air that can pass through the suction force lowering member 61A, which enables the adjustment of the suction force acting on the tablets T.

Figure 11:
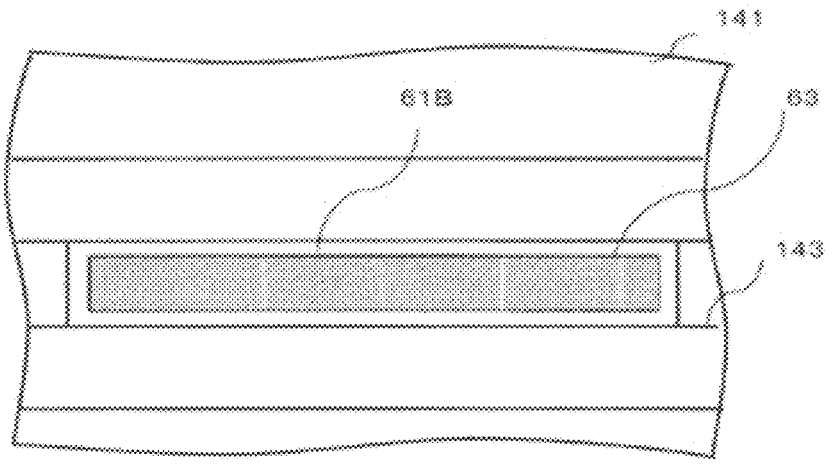
FIG. 11 is an enlarged plan view of another example of the suction force lowering member of the second embodiment.

As illustrated in FIG. 11, an opening formed in the frame-shaped suction force lowering member 61B may be covered with a porous member 63 so as to lower the suction force. With the use of the porous member 63 in this manner, pressure loss (pressure resistance) can be made uniform, resulting in less variation in suction force. The porous member 63 also serves as a filter and prevents the ingress of dust into the suction chamber 14. Besides, the gradual change of suction force along the conveying direction of the tablets T, if required as described below, can be easily achieved by gradually changing the opening ratio of pores of the porous member 63.

Figure 12:
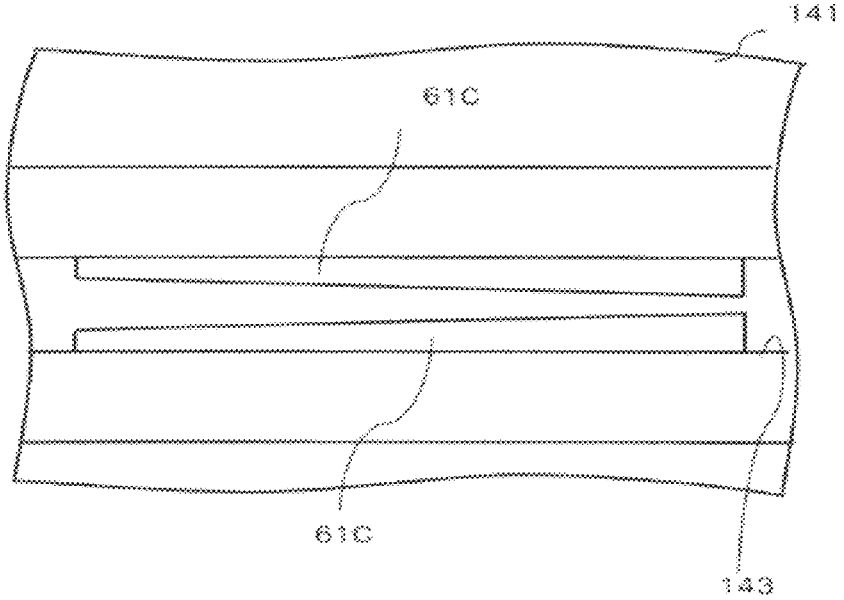
FIG. 12 is an enlarged plan view of another example of the suction force lowering member of the second embodiment.

As illustrated in FIG. 12, the opening of the suction groove 143, i.e., the suction port may be gradually narrowed by using a wedge-shaped flange portion 61C as a suction force lowering member. The use of the flange portion 61C moderates changes in suction force in the conveying direction of the tablets T, thereby suppressing the influence of airflow to low.

Figure 13:
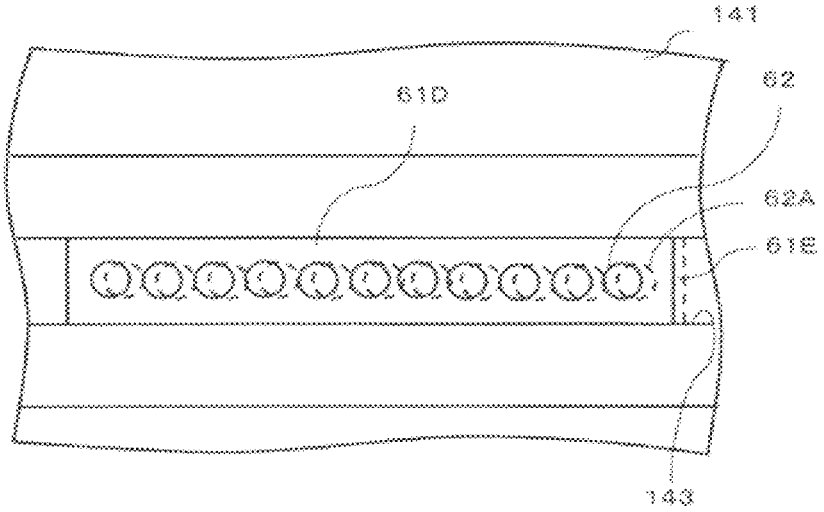
FIG. 13 is an enlarged plan view of another example of the suction force lowering member of the second embodiment.

A punched board 61D is a plate-shaped member having openings 62 as illustrated in FIG. 13. The punched board 61D may also be used as a suction force lowering member. Since the flow rate of air sucked through the openings 62 is limited, the suction force is reduced as compared to the case without the punched board 61D. By arranging the punched board 61D having the openings 62 in the suction groove 143, it is possible to avoid breakage of the conveyor belt 133 or the punched board 61D itself due to contact between the punched board 61D and the conveyor belt 133.

Further, another punched board 61E as indicated by a dotted line in FIG. 13 and the punched board 61D are arranged in layers, one on top of the other, such that they are shifted from each other. This enables adjustment of the size of the openings and the opening ratio, thereby enabling fine adjustment of the level of suction force.

Figure 14:
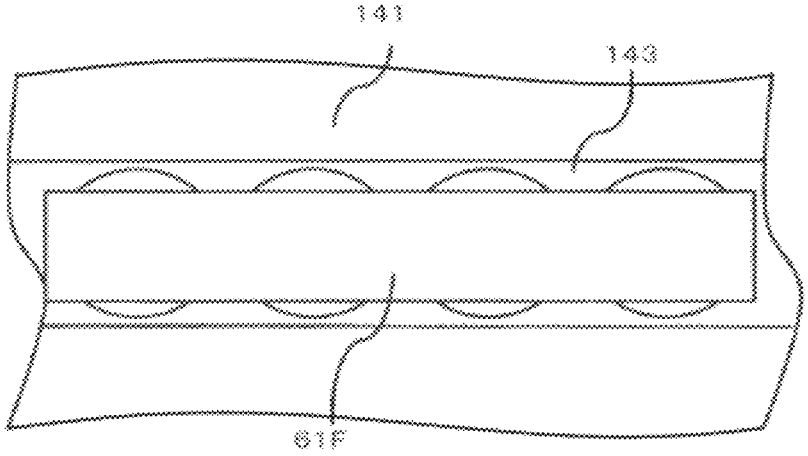
FIG. 14 is an enlarged plan view of another example of the suction force lowering member of the second embodiment.

When the suction groove 143 is formed by continuous suction holes as illustrated in FIG. 14, a flat plate member 61F may be used as a suction force lowering member. In this case, the plate member 61F is arranged so as to cover the suction holes. The plate member 61F may be the punched board 61D or the porous member 63, or it may be a mesh member (described later).

The flat plate member 61F has a width narrower than the width of the suction groove 143 formed by continuous suction holes (the diameter of the suction holes) to close part of the opening of the suction groove 143. The tablets T are sucked by the suction force applied through part not closed by the plate member 61F. The width of the closed part of the opening may be appropriately determined to adjust the suction force.

Figure 15:
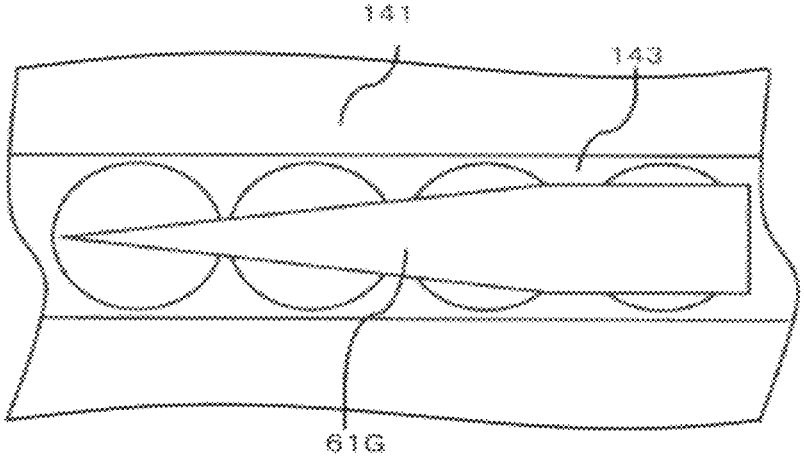
FIG. 15 is an enlarged plan view of another example of the suction force lowering member of the second embodiment.

The closed area of the opening of the suction groove 143 may be gradually changed by using a plate member 61G as illustrated in FIG. 15. This can also moderate the change in suction force depending on the place as described above. The tablets T can be prevented from shifting, shaking, or falling from the belt due to a sudden change in suction force at places where the plate member 61G is present and not present. The plate member 61G need not necessarily be in a triangle shape to change the closed area. The shape is not particularly limited, and may be determined as appropriate.

As another modification, for example, a mesh member can be used as a suction force lowering member that is a suction force adjustment device. In this case, the amount of air passing through the groove 1331 of the conveyor belt 133, i.e., the suction force can be regulated by, for example, adjusting the size of the cells of the mesh. In other words, by arranging the mesh member at the boundary between the suction groove 143 and the chamber main body 141 corresponding to the first area, it is possible to reduce the suction force applied to the tablets T passing in the first area.

The suction force applied to the tablets T passing in the first area can also be adjusted with the use of a plurality of plate-shaped members or mesh members. In this case, the members are arranged in layers so as to be shifted from one another to thereby change the size of openings such as holes or pores of the plate-shaped members and the opening ratio or the size of the mesh and the opening ratio.

Further, the suction force lowering member 61A may be formed so as to close the opening of the suction groove 143 only on the downstream side in the conveying direction of the tablets T (the upstream-side part of the frame may be removed). With this, the suction force is less reduced by the influence of airflow around the opening on the downstream side in the conveying direction. Thereby, the suction force can be gradually reduced from the upstream side in the conveying direction. Thus, it is possible to suppress the position shift or the like of the tablets T due to a sudden drop in the level of suction force.

As with the flange-shaped member that projects from both sides of the suction groove 143 so as to gradually narrow the opening area, the plate-shaped member or the mesh member can also be used to achieve this gradual change in suction force. In this case, the size of the holes or pores, or the size of the cells of the mesh is gradually reduced, spacing between them is gradually increased, or the density of them is gradually reduced.

Although the conveyor belt 133 is described as having the groove 1331 that looks like a ladder in plan view, this is by way of example. The conveyor belt 133 may have the recesses 131 as in the conveyor belt 13 described in the first embodiment. The conveyor belt 133 may also be provided with various types of suction portions as described below.

As described above, the suction of air for sucking and holding the tablets T can be properly regulated by using the suction force lowering member (for example, 61, 61A to 61G) as a suction force adjustment device. This ensures the stable ejection of ink. Thus, it is possible to provide the tablet printing apparatus S and the method thereof capable of maintaining the print quality.

With the use of the suction force lowering member (for example, 61, 61A to 61G), the suction force applied to the tablets T in each desired location can be made appropriate without dividing the suction chamber 14 into a plurality of compartments. Thereby, the structure of the suction chamber 14 can be simplified. Further, a plurality of levels of suction force can be applied to the tablets T without a plurality of suction sources. Besides, when strong suction force is applied to the tablets T, the conveyor belt 13 is strongly sucked by the suction chamber 14. This increases the contact force between the conveyor belt 13 and the suction chamber 14, making them prone to wear. By partially reducing the level of suction force, strong suction force is not applied to the entire conveyor belt 13. Thus, the wear of the conveyor belt 13 can be reduced, and the life of the conveyor belt 13 can be prolonged.

The suction force lowering member (for example, 61, 61A to 61G) may be detachably provided to the suction chamber 14. With this, the suction force or the position where the suction force is reduced can be easily adjusted. The detachability of the suction force lowering member also facilitates maintenance works such as cleaning.

The suction force lowering member (for example, 61, 61A to 61G) is described as being located in the suction groove 143 of the suction chamber 14; however, this is by way of example and not limitation. For example, the suction groove 143 may not be provided and the entire part of the suction chamber 14 in contact with the conveyor belt 13 may be the suction force lowering member.

In addition, for example, the chamber may be divided into a plurality of parts each for the belt on the upper side and the lower side of the first conveyor 1 as illustrated in FIG. 5, or it may be used without being divided as illustrated in FIG. 6. In both cases, required suction force can be set for each part where needed by using the suction force lowering member (for example, 61, 61A to 61G).

Incidentally, regardless of whether to use the suction force lowering member (for example, 61, 61A to 61G) or compartments, if there is a sudden change in suction force after printing, the tablet T shifts its position due to the change. As a result, the tablet T may move out of the field of view of the camera for print inspection or the print inspection may take longer time (when image processing is performed on the premise that the posture of the tablets T does not change, it finishes earlier). Therefore, it is desirable that the change of suction force be gradual also on the downstream side in the conveying direction as well as on the upstream side.

Other Embodiments

The above embodiments are susceptible to several modifications and variations, and various omissions, replacements, and changes can be made without departing from the scope of the invention.

In the example of FIG. 2 that illustrates the first conveyor 1, the conveyor belt 13 is provided with an array of the suction portions 130 at the center in the width direction thereof; however, there may be a plurality of arrays of the suction portions 130. In other words, the tablets T may be conveyed in a plurality of rows on one conveyor belt 13. Further, one conveyor may include a plurality of conveyor belts, and the tablets T may be conveyed in a plurality of rows on each of the conveyor belts.

Figure 16:
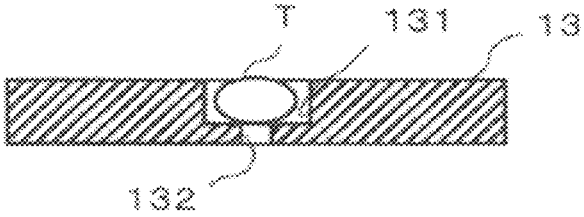
FIG. 16 is an enlarged partially cutaway cross-sectional view of a conveyor belt according to another embodiment.
Figure 17:
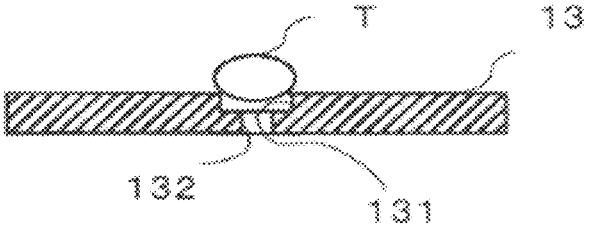
FIG. 17 is an enlarged partially cutaway cross-sectional view of a conveyor belt according to another embodiment.
Figure 18:
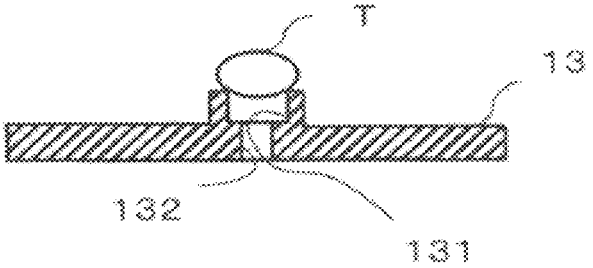
FIG. 18 is an enlarged partially cutaway cross-sectional view of a conveyor belt according to another embodiment.
Figure 19:
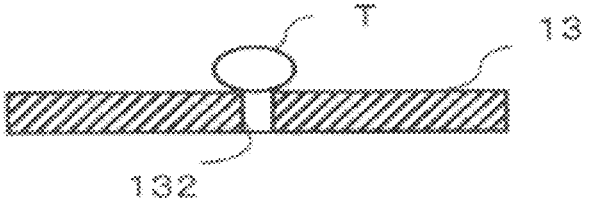
FIG. 19 is an enlarged partially cutaway cross-sectional view of a conveyor belt according to another embodiment.

The size, shape, number, and the like of the suction portion of the conveyor belt 13 (23, 133) are not limited. For example, the recess 131 may be a pocket or a groove that houses the tablet T as illustrated in FIG. 16 that illustrates a cross-sectional view of a suction portion of the conveyor belt. The recess 131 may also be formed such that the tablet T is placed thereon as illustrated in FIG. 17. Further, there may be bulged portions that form the recess 131 such as a pocket or a groove such that the tablet T is placed thereon as illustrated in FIG. 18. The suction portion need not necessarily include the recess 131, and only the suction hole 132 may be formed in the conveyor belt 13 as illustrated in FIG. 19. The suction portion may have any shape and size including the above examples as long as it can suck and hold the tablet T.

The conveyor belt 13 (23, 133) may be provided with a number of fine suction portions, or it may be made of a porous material or mesh. If such a belt is used, the tablets T need not necessarily be conveyed in a row (or rows), and may be sucked and held randomly on the belt. Further, two belts may be used so as to form a suction portion between them to thereby hold the tablets T. The two belts may be joined together at intervals in a ladder fashion. Besides, when there is a larger the opening or holes (pores) around the tablet T and suction is performed, the influence on printing is larger. Therefore, it is more effective to reduce airflow caused by suction during printing. For this purpose, various approaches can be adopted as to how to convey the tablets.

As described above, the suction chamber (for example, 14, 24) need not necessarily apply suction force to the entire circumference of the conveyor belt 13 to suck the tablets T. For example, when print is applied to only one side of the tablets T, one conveying device suffices for printing. In this case, the tablets T are discharged around the part where they are reversed as being conveyed. Since there is no tablet T on the conveyor belt 13 from where the tablets T are discharged to where new ones are received (supplied), suction is not required. Further, for example, when printing is performed on both the upper and lower surfaces of the tablets T as in the tablet printing apparatus 10 in FIG. 6, there is no tablet T on the conveyor belt 13, 23 from where the tablets T are transferred from the first conveyor 1 to the second conveyor 2 or from where they are discharged from the second conveyor 2 to where new ones are supplied. Therefore, suction is not required. Accordingly, the suction chamber (for example, 14, 24) is not needed in these places where there is no tablet T to be sucked and held. For example, part of the suction chamber 14 may be eliminated around the driven pulley on the downstream side of where the tablets T are transferred from the first conveyor 1 to the second conveyor 2.

The level of suction force is adjusted by adjusting the suction pressure, the amount of air sucked, the speed of air suction (wind speed). That is, the suction force is a concept that includes wind speed and pressure.

Further, the first embodiment, in which the suction force of the suction chamber 14 is adjusted depending on areas, may be implemented in combination with any other embodiment(s). With this, the suction force applied to the tablets T can be more finely set and adjusted according to the area where they are being conveyed.

As a driving element of the inkjet print head H, a piezoelectric element, a heating element, a magnetostrictive element, or the like can be used.

Examples of the tablets include plain tablets (uncoated tablets), sugar-coated tablets, film-coated tablets, enteric coated tablets, gelatin coated tablets, multilayered tablets, dry-coated tablets, and the like. Examples of the tablets further include various capsule tablets such as hard capsules and soft capsules. The tablets may include those for pharmaceutical use, edible use, cleaning, industrial use, and aromatic use.

In the case where tablets to be printed are for pharmaceutical use and edible use, edible ink is suitably used. Specifically, edible pigment such as Amaranth, Erythrosine, New Coccine (red), Tartrazine, Sunset Yellow FCF, β-Carotene, Crocin (yellow), Brilliant Blue FCF, Indigo Carmine (blue), or the like is dispersed or dissolved in a vehicle, and, if necessary, a pigment dispersant (surfactant) is blended therein, the resultant of which can be used. As the edible ink, any of synthetic dye ink, natural color ink, dye ink, and pigment ink may be used.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A tablet printing apparatus, comprising:

a conveyor configured to convey tablets sequentially supplied while sucking and holding the tablets;

a print head arranged to face the conveyor, and configured to eject ink to each of the tablets conveyed by the conveyor to perform printing;

a detector located upstream of the print head in conveying direction of the tablets, and configured to detect posture of each of the tablets sucked and held by the conveyor; and a print condition tester located downstream of the print head in the conveying direction of the tablets, and configured to check print condition on each of the tablets sucked and held by the conveyor, wherein the conveyor includes a first area and a second area, the first area includes at least an area from a detection position where the detector detects the tablets to a check position where the print condition tester checks the print condition on the tablets, the second area includes other area than the first area except for an area where no suction force is applied to the tablets, and suction force applied to the tablets is smaller in the first area than in the second area, wherein the tablet printing apparatus further comprises a suction force adjuster configured to reduce the suction force applied to the tablets in the first area smaller than that in the second area, wherein the conveyor includes a suction chamber configured to apply the suction force to the tablets, the suction chamber is divided into compartments including a compartment corresponding to the first area and a compartment corresponding to the other area, the suction force adjuster is configured to be able to set level of the suction force with respect to each of the compartments, and the suction force adjuster is further configured to reduce the level of the suction force that the compartment corresponding to the first area applies to the tablets lower than that of the compartment corresponding to the other area.

2. The tablet printing apparatus according to claim 1, wherein the second area includes an area where the tablets are conveyed as being sucked and held against their self-weight or centrifugal force.

3. The tablet printing apparatus according to claim 1, wherein the suction force applied to the tablets is uniform in the entire first area.

4. The tablet printing apparatus according to claim 1, wherein the conveyor includes suction portions configured to suck the tablets, and the suction force adjuster includes a suction force lowering member configured to reduce the suction force applied to the tablets in the first area in the suction portions smaller than that in the other area.

5. The tablet printing apparatus according to claim 4, wherein the suction force lowering member is configured to make opening of the suction portion narrower in the first area than in the other area, and the suction force lowering member is made of one selected from a flange-shaped member, a frame-shaped member, a plate-shaped member, a porous member, and a mesh member.

6. A tablet printing apparatus, comprising:

a conveyor configured to convey tablets sequentially supplied while sucking and holding the tablets;

a print head arranged to face the conveyor, and configured to eject ink to each of the tablets conveyed by the conveyor to perform printing;

a detector located upstream of the print head in conveying direction of the tablets, and configured to detect posture of each of the tablets sucked and held by the conveyor;

a print condition tester located downstream of the print head in the conveying direction of the tablets, and configured to check print condition on each of the tablets sucked and held by the conveyor; and a tablet supplier configured to supply the tablets to the conveyor, wherein the conveyor includes a first area and a second area, in an area between a supply position where the tablet supplier supplies the tablets to the conveyor and a check position where the print condition tester checks the print condition on the tablets, the first area includes at least an area from a detection position where the detector detects the tablets to the check position, and the second area includes other area than the first area in the area between the supply position and the check position, wherein the tablet printing apparatus further comprises a suction force adjuster configured to reduce the suction force applied to the tablets in the first area smaller than that in the second area, wherein the conveyor includes a suction chamber configured to apply the suction force to the tablets, the suction chamber is divided into compartments including a compartment corresponding to the first area and a compartment corresponding to the other area, the suction force adjuster is configured to be able to set level of the suction force with respect to each of the compartments, and the suction force adjuster is further configured to reduce the level of the suction force that the compartment corresponding to the first area applies to the tablets lower than that of the compartment corresponding to the other area.

7. A tablet printing method, comprising:

conveying, via a conveyor, tablets sequentially supplied while sucking and holding the tablets;

detecting, via a detector, posture of each of the tablets being conveyed;

ejecting, via a print head, ink to each of the tablets conveyed as being sucked and held to perform printing based on detection information;

checking, via a print condition tester, print condition on each of the tablets being conveyed;

reducing, via a section for adjuster, a suction force applied to the tablets at least in an area from a detection position where the tablets are detected to a check position where the print condition on the tablets is checked than in other area, wherein the conveyor includes a suction chamber configured to apply the suction force to the tablets, the suction chamber is divided into compartments including a compartment corresponding to the area from a detection position where the tablets are detected to a check position where the tablets are checked of print condition and a compartment corresponding to the other area, the suction force adjuster sets a level of the suction force with respect to each of the compartments, and the suction force adjuster reduces the level of the suction force that the compartment corresponding to the area from a detection position where the tablets are detected to a check position where the tablets are checked of print condition applies to the tablets lower than that of the compartment corresponding to the other area.

* * * * *